US006611208B1

(12) United States Patent
Ketler

(10) Patent No.: US 6,611,208 B1
(45) **Date of Patent: *Aug. 26, 2003**

(54) INTEGRATED FIELD MONITORING AND COMMUNICATIONS SYSTEM

(75) Inventor: Albert E. Ketler, Murrysville, PA (US)

(73) Assignee: Rel-Tek, Monroeville, PA (US)

( * ) Notice: Subject to any disclaimer, the term of this patent is extended or adjusted under 35 U.S.C. 154(b) by 7 days.

This patent is subject to a terminal disclaimer.

(21) Appl. No.: 09/865,600

(22) Filed: May 29, 2001

Related U.S. Application Data

(63) Continuation-in-part of application No. 09/750,184, filed on Dec. 29, 2000, now abandoned, which is a continuation of application No. 09/121,987, filed on Jul. 24, 1998, now Pat. No. 6,169,488.

(51) Int. Cl.[7] ..... G08B 21/00

(52) U.S. Cl. ..... 340/632; 340/534; 340/538; 73/23.2

(58) Field of Search ..... 340/632, 534, 340/538, 501, 539; 73/23.2, 1.07, 1.01, 1.02, 1.06

(56) References Cited

U.S. PATENT DOCUMENTS 3,090,038 A 5/1963 Klein et al.
3,209,343 A 9/1965 Dunham et al.
3,482,233 A 12/1969 Ogg
3,789,231 A 1/1974 Hayden
3,978,476 A 8/1976 Tanigawa
4,067,004 A 1/1978 Gulbrantson
4,119,950 A 10/1978 Redding
4,340,885 A 7/1982 Chavis et al.
4,384,925 A 5/1983 Stetter et al.
4,555,930 A * 12/1985 Leach et al. ..... 73/23
5,305,639 A 4/1994 Pontefract
5,576,739 A 11/1996 Murphy

* cited by examiner

*Primary Examiner*—Julie Lieu
(74) *Attorney, Agent, or Firm*—Browdy & Neimark PLLC

(57) ABSTRACT

A field monitoring and communication system for arranging circuits and components for environmental and other types of monitoring systems includes:

(a) microprocessor-based modules for communications and a variety of input/output types and combinations:

(b) remote and optionally, proximal calibration and regulator modules:

(c) a variety of sensor inputs optionally comprising intrinsically safe barriers.

12 Claims, 7 Drawing Sheets

EARTH GROUND
OPTIONAL DX-LINK
OPTIONAL DX8000 DX4404 DX0800or DX0008
OPTIONAL DX 2202
OPTIONAL AC / DC POWER SUPPLY
ALARM RESET
EMERGENCY STOP
BLK
RED
OPTIONAL DRAWING POCKET
A
B
C
D

INTEGRATED FIELD MONITORING AND COMMUNICATIONS SYSTEM

CROSS-REFERENCE TO RELATED APPLICATION

The present application is a continuation in part of application Ser. No. 09/750,184, filed Dec. 29, 2000, now abandoned, which is a continuation of application Ser. No. 09/121,987, filed Jul. 24, 1998 and now U.S. Pat. No. 6,169,488, the entire contents of which being incorporated herein by reference.

FIELD OF THE INVENTION

The present invention relates to a system for arranging circuits and components for monitoring gases, humidity, smoke, temperature, pressure, vibrations, rpms, speed, and other environmental factors. The system also provides for controlling alarms to alert system operators to potential dangers.

BACKGROUND OF THE INVENTION

Environmental monitors protect life and property. In an industrial setting, such detectors typically use remote sensors so that the presence of smoke, hazardous gases, excessive humidity, temperature variations, or the like may quickly be detected at a remote location of a facility or process. Other monitors provide information regarding ambient pressure, humidity and/or temperature, or vibration, speed, and/or RPMs of nearby machinery or vehicles. These monitors may also be adapted to measure optical obscuration, turbidity, radio frequency, viscosity, force and weight, torque and electrical and mechanical parameters such as voltage, current, frequency, shock, vibration and acoustics. This information is usually reported electronically to a control room. Relevant parameters (e.g., concentration of a noxious gas, average RPMs, etc.) are recorded and analyzed by computer and alarms, or other signal means (hereinafter alarms) are automatically activated when the measured parameter exceeds or falls below certain preset values or ranges.

Conventional prior art sensors are individually wired to the field location from a central control panel, using whatever number of wires are required to deliver the power and return the information. There are usually a minimum of three to five wires for each sensor. Boxes located in the field interconnect the wiring from the field location to a central computer read-out. As the number of sensors increases, the number of wires to be brought into the read-out area also increases, making the read-out area increasingly complex, and making installation of the sensors and read-out difficult and costly.

Supporting electronics for monitoring large numbers of monitors in close proximity usually occupies a vast amount of wall space and require expensive conduit, cables, and labor to interconnect.

Major problems in any detection and alarm system are safety and reliability. To ensure safety and efficacy, an operator must frequently check and calibrate each sensor in the alarm system. Such periodic calibration is necessary to ensure the accuracy of the sensors. Furthermore, sensors for hazardous gases which are lighter than air (e.g., methane, hydrogen) are often situated high above the ground, making it inconvenient, even dangerous, to physically approach the sensor to apply calibration gas and adjust the output.

Leach et al., in U.S. Pat. No. 4,555,930, provide a system for minimizing the number of wires used to connect sensors to a control room. Each sensor has its own digital code, so that, when the satellite unit addresses a sensor, the sensor responds with a code that differs from the satellite unit by one parity bit. This system provides zero and span calibration of the sensors. The odd/even parity transmission mode makes it possible to connect a plurality of sensors to a satellite subassembly.

Redding, U.S. Pat. No. 4,119,950, discloses an apparatus for monitoring gas content on a site comprising a transmitter for feeding ultrasonic waves through the gas to a receiver. A plurality of transmitter/receiver pairs can be enabled in sequence to monitor a large area, with the respective frequencies or phase displacement monitored by a central processor. However, there is no indication that the connections to the central processor can be minimized in any way.

Gulbrantson, U.S. Pat. No. 4,067,004, discloses a remote carbon monoxide monitoring system, including a control panel and remote alarm stations. Although the system can be connected to a large number of remote alarm stations, there is no indication that connections to the control panel can be minimized by any type of arrangement.

Klein et al., U.S. Pat. No. 3,090,038, disclose a hazardous atmosphere detecting and signaling system for combustible gases which is less than that which will produce an explosion in the air at that moment. In this apparatus, the gas sampled is enriched with the gas to be detected and exploded.

Other gas sensing devices are shown in U.S. Patents to Ogg, U.S. Pat. No. 3,482,233; Chavis, U.S. Pat. Nos. 4,340,885; 4,119,950; Hayden, U.S. Pat. No. 3,789,231; Stetter et al., U.S. Pat. No. 4,384,925; Murphy, U.S. Pat. No. 5,576,739; Tanigawa, U.S. Pat. No. 3,978,476; and Dunham et al., U.S. Pat. No. 3,209,343.

SUMMARY OF THE INVENTION

It is an object of the present invention to overcome the aforesaid deficiencies in the prior art.

It is another object of the present invention to provide a unique arrangement of circuits and components to facilitate field installation of monitoring sensors.

It is a further object of the present invention to provide a system for environmental monitoring in which sensors can be calibrated from a safe, remote location.

It is a further object of the present invention to provide a system for environmental monitoring having an integrated field panel for connections from the sensor clusters to a central monitoring location.

According to the present invention, a complete and modular arrangement of wiring for remote sensors and monitoring stations is provided which comprises a communication box for managing large numbers of sensors throughout large buildings, mines, tunnels and other such facilities. The system of the present invention comprises long distance communications, remote calibration and regulator modules, and optional intrinsic safety barriers in one compact module. Also included are relays for controlling alarms and plant functions. The module can optionally house an AC/DC power supply with attendant backup batteries. A strobe and horn can be added, as well as essential field switches, for emergency stop and alarm reset.

In the system according to the present invention, remote sensors are positioned so as to provide the most effective, accurate measurement of one or more parameters of interest. For example, in measuring the concentration of a gas, such as propane, which is heavier than air, sensors are located near the ground or the floor. Conversely, for a gas, such as methane, which is lighter than air, sensors are located high above ground level. For measuring temperature, the sensors are located where temperature variations are most critical. One skilled in the art can readily determine the optimum location for sensors for other conditions, without undue experimentation. The system also provides intrinsic safety barriers for measuring any hazardous conditions such as the presence of explosive mixtures.

BRIEF DESCRIPTION OF THE DRAWINGS

FIG. 4 illustrates the arrangement of the input/output box of the system of the present invention.

FIG. 6A shows an individual gas manifold.

DETAILED DESCRIPTION OF THE INVENTION

The present invention provides a unique arrangement of circuits and components which greatly facilitates field installation of environmental monitoring equipment. The arrangement of the present invention consolidates the "octopus" of conventional wall-mounted boxes. Whereas traditional wall boxes require tedious and costly field interwiring, the arrangement of the present invention can be easily and inexpensively assembled to connect sensors to a receiving station.

Figure 1:
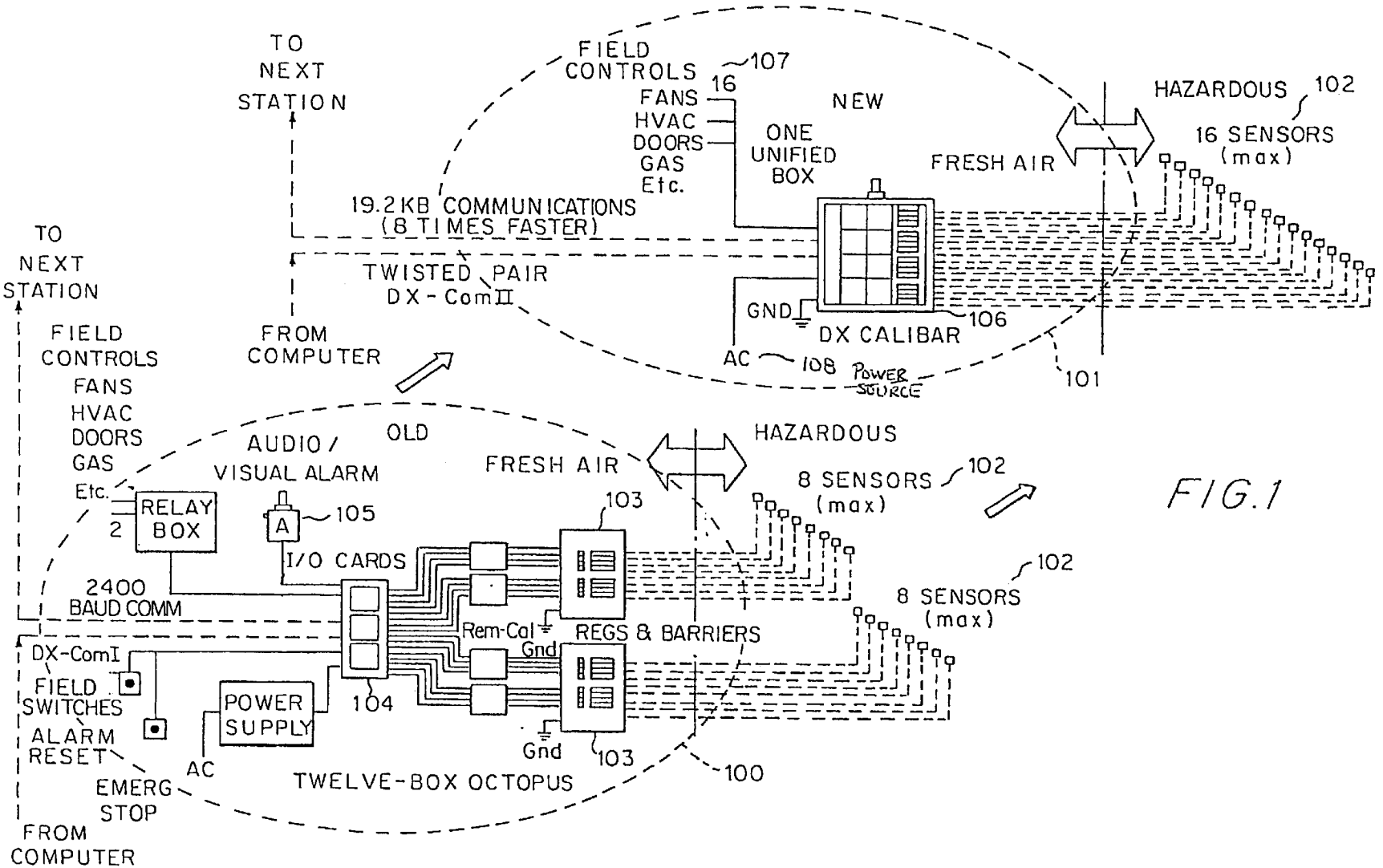
FIG. 1 compares the field communications panel of the present invention with conventional monitoring and equipment interfacing apparatus.

FIG. 1 illustrates the differences between the conventional arrangement 100 and that of the present invention 101. The conventional arrangement 100 provides groups of eight sensors 102 (the maximum that can be conveniently handled by this type of arrangement) feeding through current regulators and intrinsic safety barriers 103 into input/output tabulating cards 104. These input/output cards 104 feed into an alarm 105 to signal a warning when the parameter being monitored (e.g., temperature or vibrations) nears the boundaries of a predetermined value or range of values. A power supply 106 is connected to the input/output cards and provides power to all components, including sensors, alarms and cards.

FIG. 1 also shows the arrangement according to the present invention 101. In this arrangement, sixteen sensors 102 can be handled by one unified box 106. This box 106 is connected to field controls 107 and a power source 108. It can readily be seen that the concise arrangement of the present invention provides easier installation than the conventional "octopus," requiring less wire and conduit, less wall space, and therefore less costly field labor than the latter. Because the present arrangement occupies less wall space, it has a neater appearance, affords greater reliability than conventional arrangements. Moreover, it is easier to troubleshoot problems arising in the unified box, as corrections and changes can be made to modules rather than to individual connections.

In order to fit a standard 24×24×6 inch box size, the unified box (106) of the present invention comprises sixteen sensor inputs (102), each sensor having a 4–20 mA generic analog format. When the environmental parameter to be measured is potentially hazardous (i.e. explosive or flammable), the device includes sixteen optional dual-channel intrinsic safety barriers (See FIG. 6), one barrier for each sensor. Power reaches each sensor through one channel of the barrier, and the signal is returned through the second channel. Sensor types contemplated for use with the unit include the GasBoss*100 and GasBoss*100/AP, among these manufactured by REL-TEK of Monroeville, Pa. These are combustible gas sensors with a range of 0–100% LEL, both approved to UL-913, Class 1, Division I, Group D. (Group D includes methane, natural gas, propane, butane, gasoline, diesel fuel, naphtha, alcohol and a host of other medium flammability fuels.) However, other types of conventional sensors can be used in the arrangement of the present invention, depending upon the environmental parameter being measured.

As mentioned above, each barrier unit may optionally contain two intrinsic safety barrier channels. These intrinsic safety barriers transmit power to the sensor with a first channel and retrieve the analog signal from the sensor through a second channel. The relatively small dimensions of these intrinsic safety barriers (10033 19 mm cross-section) and their compact spacing provides maximum packing density, which in turn minimizes the sizes of the attendant enclosure. Each channel is fused at ¼ amp for power transfer. No costly mounting rails or hardware are required because the barriers can be screwed directly to a grounded metal chassis, although such rails and hardware could be employed with the intent of this invention. The safety barriers are bi-polar, transferring AC, DC, analog, digital, or tone signals. Current limiters protect the barriers against short circuits, avoiding the use of external, replaceable fuses; and 4–20 mA signal regenerators interface with high impedance analog terminations, e.g., with PLCs (programmable logic controllers). These PLCs are conventional computers widely used for industrial control and are manufactured by companies like Allen Bradley, Siemens and General Electric. Among the preferred intrinsic safety barriers are types SG, SH, and SL, manufactured by REL-TEK of Monroeville, Pa.

The safety barrier channels render the sensors intrinsically safe. These safe sensors incur lower maintenance costs compared with the alternative, i.e., explosion-proof sensors. The latter lose their safety classifications whenever their X/P housings are opened. Furthermore, because the intrinsic safety sensors are powered through approved intrinsic safety barriers, the sensors can be serviced or replaced without disabling the entire monitoring system or shutting down operations and declassifying the area under repair.

In the event that a sensor registers an anomaly, alarms or other alerting devices can be sounded, and actions taken to return parameters to normal. For example, if an explosive gas is detected, the system can selectively turn off lights and heaters, cut off electrical main power, gas lines and the like. In the event that an excess temperature is reached, the system is programmed to respond appropriately. Conventional arrangements rely upon separate relay boxes for housing the high current control contacts. In contrast, the present invention provides sixteen individually controlled relays, each relay having gold-plated SPDT contacts rated as 24VDC/5A and 110VAC/5A.

Figure 2:
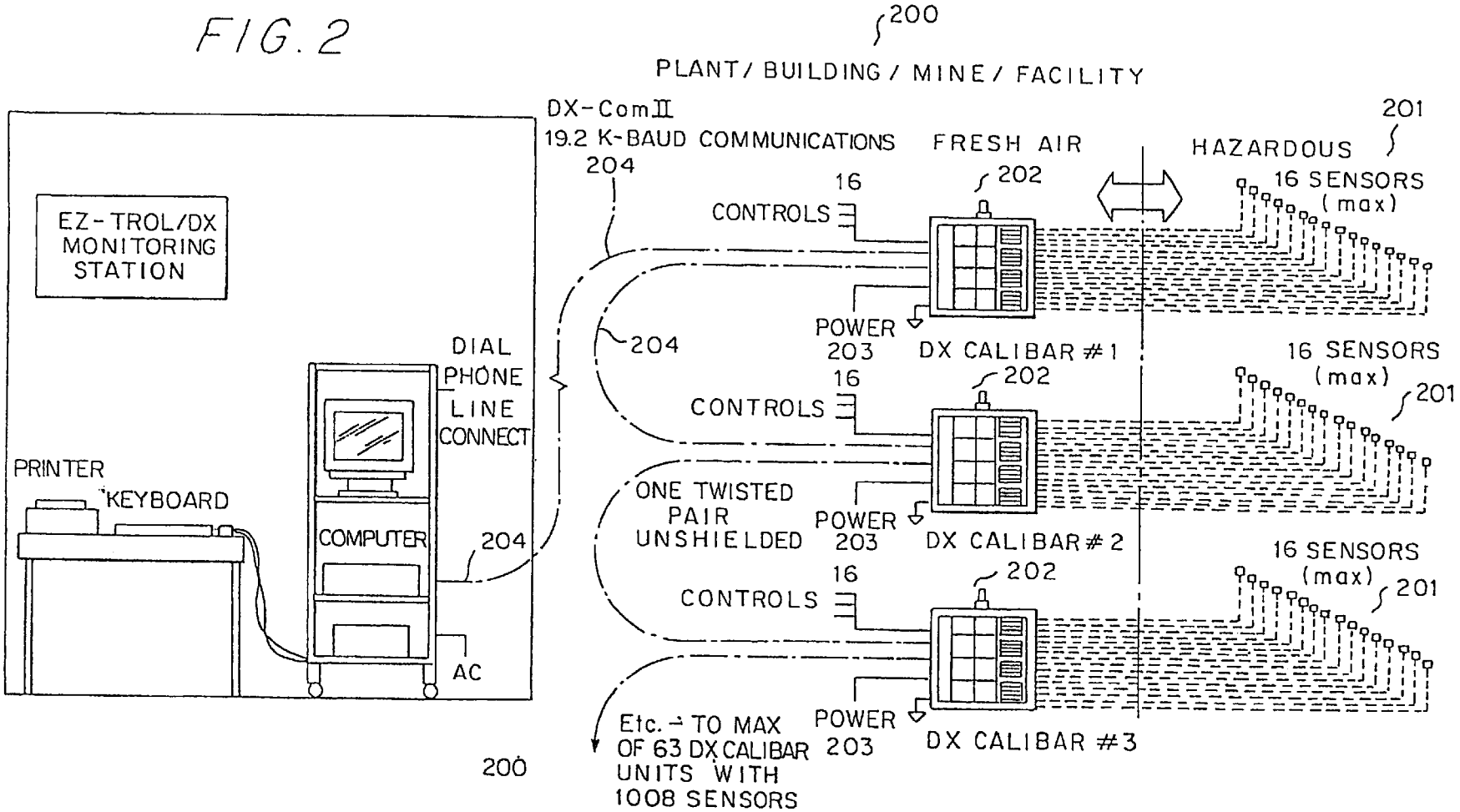
FIG. 2 is a schematic illustrating the overall monitoring system of the present invention.

FIG. 2 shows an overall schematic of the monitoring system of the present invention 200. Sixteen sensors 201 per unit box 202 feed signals from the monitored area into a separate location, where the unit boxes are located in a plant, building, mine, or other facility. Alternatively, the unit box is configured to withstand the environmental parameters being measured (e.g., insulated against humidity or radiation) if placing the unit box in a controlled area is not feasible. An AC/DC power source 203 provides each unit box with DC power, or 24 VDC power can be brought from an adjacent, AC/DC powered unit. A communications bus 204 connects the unit boxes with a central computer 205. The unit box 202 can house an AC/DC power supply with attendant backup batteries. Relays for controlling alarms or other signals and plant functions such as fans, doors, shunt breakers and the like are included in the arrangement. A strobe and horn can be added, as well as essential field switches for emergency stop, alarm reset, or the like.

Figure 3:
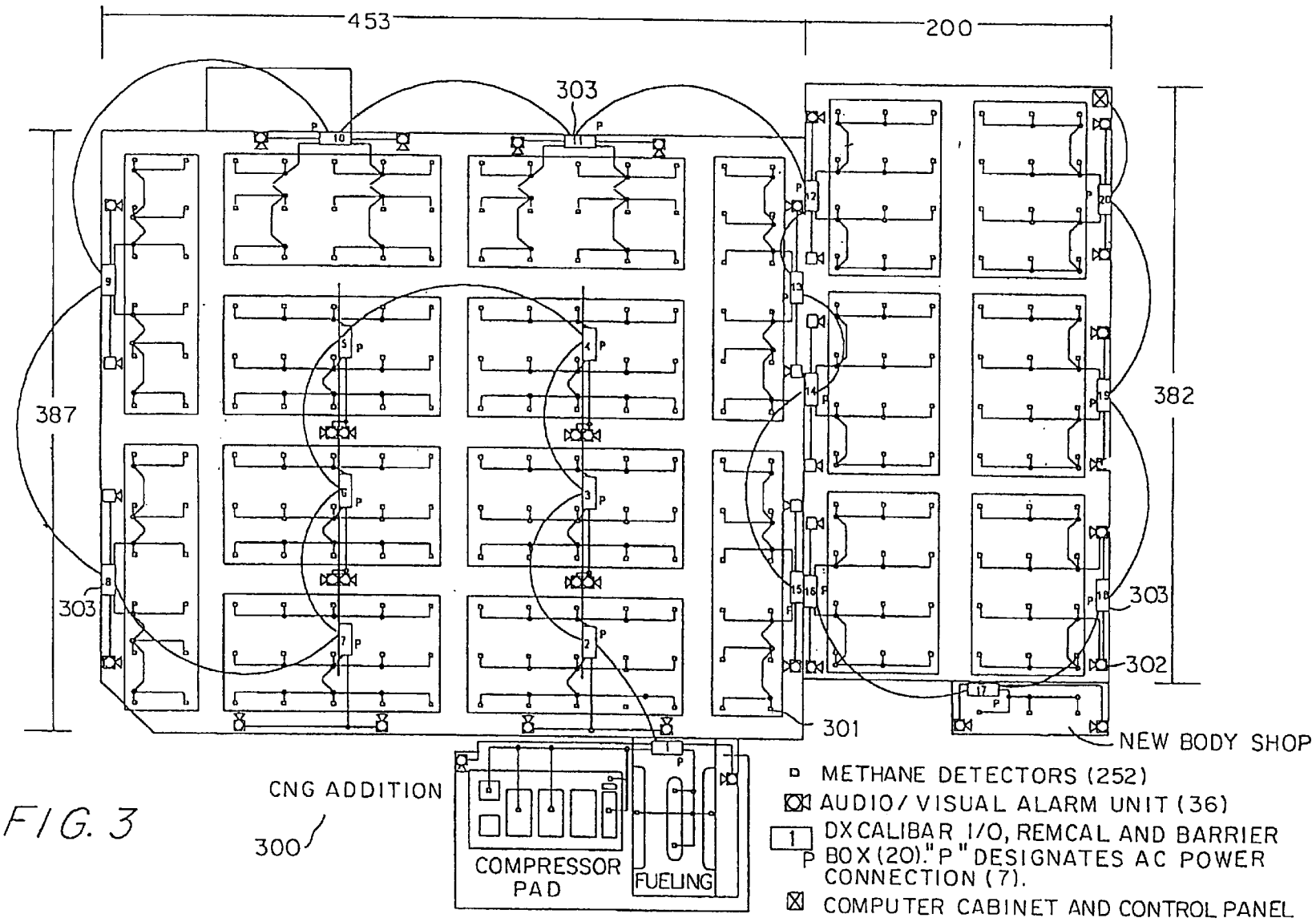
FIG. 3 is a schematic of a large bus garage outfitted with the communications panels and monitoring devices according to the present invention.

FIG. 3 illustrates an arrangement 300 for monitoring environmental parameters in a large transit bus maintenance and storage garage. For example, 252 methane detectors 301 are placed at appropriate 32-foot square grids throughout the garage. Alarm units 302 are also located throughout the garage to warn when the concentration of hazardous gas exceeds a predetermined limit. The unit boxes of the present invention 303 are connected to one another and ultimately to the computer by conventional wiring in one continuous circuit.

Here, for example, sensors 301 are required for monitoring combustible methane gas concentrations, usually in the range of 0–100% LEL (lower explosion limit). The gas sensors 301 are provided at the rate of approximately one for every 1000 square feet of floor space. Because methane is lighter than air, the sensors 301 are usually mounted high, about two feet beneath a 25 foot ceiling, where the gas tends to accumulate. A computer stationed in a supervisory office monitors all the sensors, preferably at intervals not exceeding 20 seconds. In this example, a total of twenty (20) unit boxes 303 of the present invention are strategically sited throughout the facility, each connecting to 12–16 sensors. The sensors are sited in areas deemed hazardous, while the boxes 303 are sited at eye level in an area designated as non-hazardous. A hazardous/non-hazardous demarcation is established for each facility. In this case, the demarcation is ten feet above floor level: Above this line is considered hazardous, below is safe.

Because the sensors 301 are sited high above the floor, it is very inconvenient, and even dangerous, to physically approach the sensor to periodically apply calibration gas and adjust the output. Consequently, the present invention permits the operator to calibrate the sensors from floor level using the circuitry contained in the mid-section of the unit boxes. For purposes of illustration, one module, services four sensors so that the full complement of sixteen sensors per box requires four modules. Each module contains four identical paths, each having circuitry and potentiometers for adjusting the zero and span of each sensor signal. The sensor signal is terminated, and a new signal generated, which is passed on to monitoring circuitry. The signal output from the module thus overrides the raw signal coming from the sensor, which may have drifted due to aging, ambient conditions, or the like. Test jacks (e.g., 2 mm diameter) are provided on each circuit for easily monitoring a sensor's output signal, as well as the newly-calibrated signal (which is determined using an appropriate portable measuring instrument).

Figures 4A, 4B:
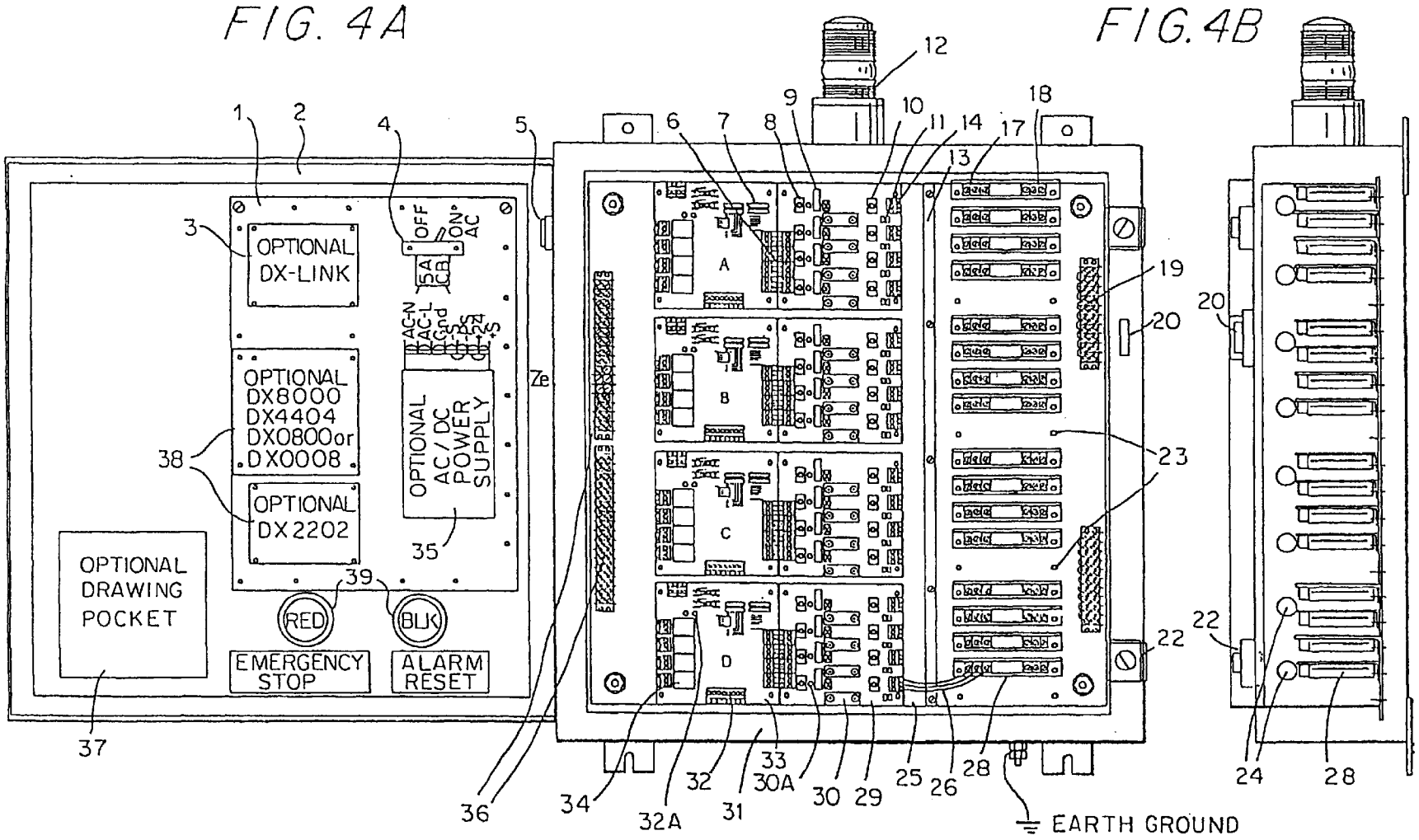
FIG. 4A shows a front view of the input/output box.
FIG. 4B shows a side view of the input/output box.

FIG. 4 shows the inside of the unit box 400 of the present invention, which is preferably made of steel or plastic. An optional auxiliary panel 1 is located inside the front door 2 of the unit box; this front door 2 may be hinged. An optional communication repeater 3 may be provided on the optional auxiliary panel 1. An AC power switch and fuse 4 are located on the optional auxiliary panel 1, or may be located on the inside of the front door 2. An optional horn 5 is mounted on the side of the unit box. On the inside of the unit box 400, is located a 4-analog signal connector 6. The connector plugs the cards together, passing four analog signals without requiring field wiring. Communication addresses (from 1–253) are provided at 7. Calibration signal jacks 8 are located near span/zero cal adjustment pots 9. Raw signal jacks are provided at 10, near regulator current switches 11. The current selected may vary from 50, 85, 95, 130, etc. ma. An optional strobe (flasher) 12, serving as an alarm signal, is located on top of the unit box for easy visibility. A metal divider plate separates the non-intrinsically safe circuit components 1–14 and 29–38 from intrinsic safety barriers 28. Terminal strips 14 are wired to the barriers 28. The separate "safe area" side of the barriers 28 is shown at 18, and the hazardous side of the barriers 28 is shown at 17. The power side of the optional intrinsic safety barrier terminals is at 17, and the sensor interface of the intrinsic security barrier terminals is shown at 18. Sensor cable shield ground terminals 19 are located beyond the intrinsic safety terminals. Four intrinsic safety barriers 28 are provided for each unified strip.

A lock hasp 20 can be used to secure the unit box in a closed position, and screw-tightening door fasteners 22 are provided. Four extra barrier spaces 23 are provided for controlling hazardous outputs. Wire feed holes 24, generally eight, are provided for introducing wires through the divider plate 13. Other holes, not shown, are provided on the box sides to permit cable to enter the box. The backplate 25 of the box provides an organizing and removable mounting for the components thereon.

A Rem-Cal card, 29, which is a proprietary remote calibration, current regulator, and signal regenerator card, is connected by jumper wires (not all shown) to each intrinsic safety barrier 28.

The unit box also includes four DX4404B cards, which are proprietary multipurpose field input-output cards, each with 4 analog inputs, 4 digital inputs, and 4 digital outputs (SPDT relays). There are four control relays 34 per card, each with typically SPDT, 110/220VAC 5 AMP contacts.

Current regulator heat sinks are provided at 30. An LED 30A indicates the magnitude of the sensor signal.

Four digital inputs 32 per DX4404B card 33 are provided for dry contacts (switches). Blinking LEDs 32A show communication polling and responses between the remote computer and each DX4404B card.

Field interface terminals 36 for accommodating any field wiring, except for the intrinsic safety sensors, are optional, as is a document storage compartment 37 on the inside of the front door 2. Optional auxiliary input-output cards 38 for sensing and/or controlling extra sensors, alarms, etc., in non-hazardous areas can be located in the unit box. Optional push button switches 39 can be mounted on the front door 2, accessible from the outside front of a closed box.

Figure 5:
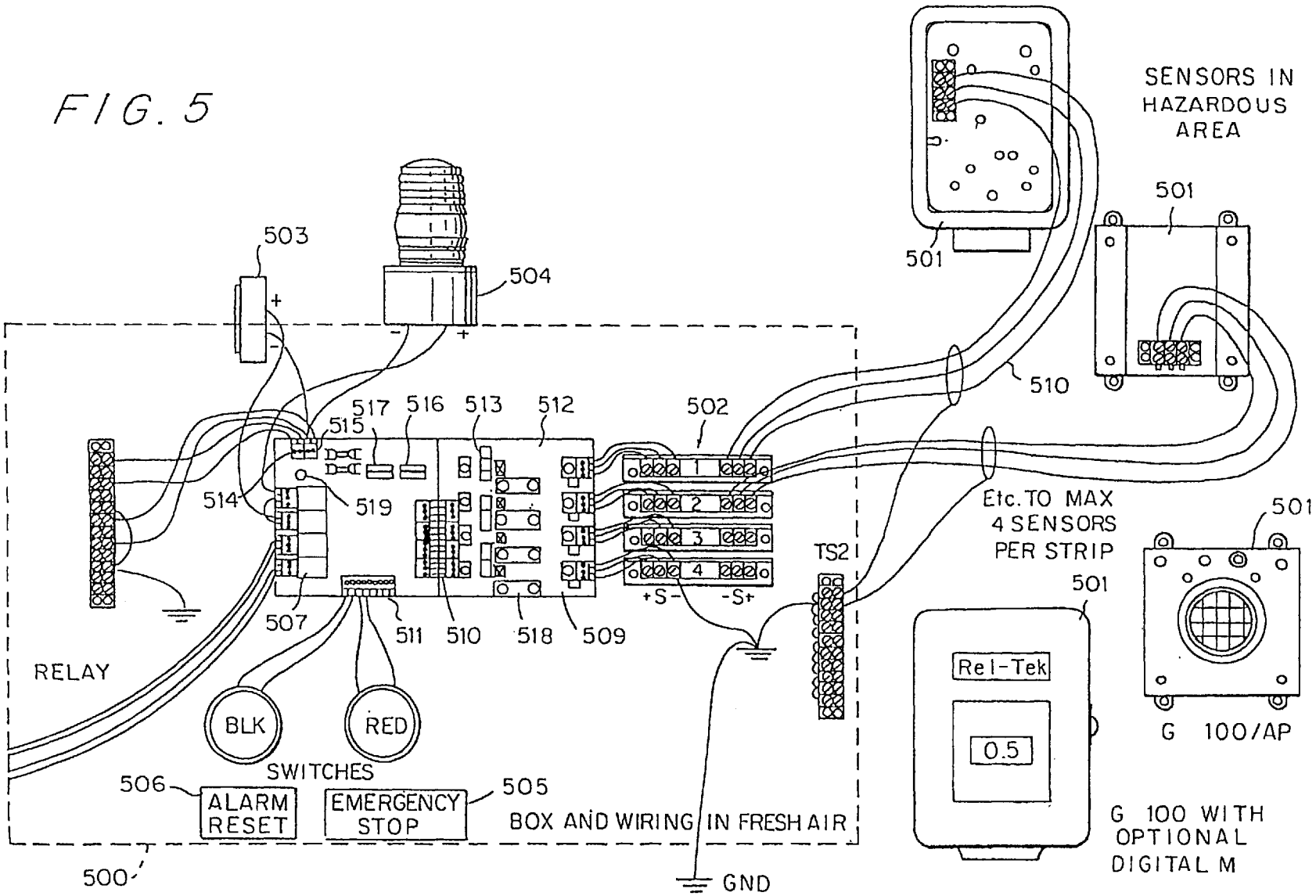
FIG. 5 illustrates the connections between sensors and the input/output box of the present invention.

FIG. 5 illustrates the connections between four sensors 501 and a typical strip within the unit box 500. The sensors 501 are located in a potentially hazardous area, when the parameter of interest is hazardous (e.g. flammable gas), while the unit box 500 is located in a separate "safe" area.

Shielded cables 510 transmit analog signals from the sensors 501 through the intrinsic safety barriers 502 and onto the electric circuit cards. Using other optional cables, control signals to and from a horn 503, a strobe 504, an emergency stop 505, and an alarm reset 506 are connected. Relays 507 transmit commands for activating external alarms and controlling plant functions (e.g., opening doors, removing power, etc.). Communications with a central computer transfer sensor data, digital inputs and control commands in a digital format.

FIG. 5 shows typical wiring for one strip 500 in the unit box of the present invention. A typical 4-channel strip includes a DX4404B card 508, a Rem-Cal card 509, a dual-channel barrier set 502, four 4–20 mA sensor signals 510, four dry contact inputs 511, 110V/5ASPDT relays 507, in/out signal test jacks 512, zero and span pots 513, DX-com input 514, 24 VDC power supply input 515, an address set 516, a DO state and baud set 517, and a regulator current set 518.

The unit box and the sensors operate from 24–28 VDC, typically drawing 2–4 amps per box, fully loaded. A high efficiency switching power supply can be mounted inside the enclosure. There is also room in the box for a rechargeable battery, typically 2–8 AH, providing the capacity for powering the unit, with normal sensor and alarm loads, for 15–20 minutes, and assuring proper shutdown, in the event of a longterm power outage.

A raucous horn 503 and a strobe 504 can be mounted directly on the unit box, thus eliminating more components typical of the conventional octopus arrangement. If desired, additional alarms can still be sited remotely from the box, powered and controlled in unison or individually, using outputs from the unit box.

Each four channel, side-to-side strip of components 500 is independent of each other, and more or fewer of these strips can be included to meet the sensor count at the particular site. Because the strips are identical, just one set of components provides spares for all strips, including those in other units throughout the facility.

A blinking LED 519 shows the communication status of each module and sensor. A malfunction is visibly indicated, making troubleshooting fast and easy.

The barriers 502, as connected, are short-circuit protected, such that an external wiring short on a sensor circuit will not damage the attendant barrier. Unlike with old barrier arrangements that were frequently destroyed by a short circuit, the high-speed current limits avoid this problem. Additionally, there are no fuses to replace.

For ease of maintenance, the DX4404B card 508 and Rem-Cal module 509 plug together at 510. Replacing either module is reduced to simply pulling the plugs, lifting the module off stand-offs, inserting a replacement module, and replacing the plugs.

The unit box (FIG. 4) includes unused space inside with holes provided for adding extra input/output 38 cards and utility modules 3, as may be needed for extra monitoring, custom control functions, or to add a communications repeater and optical isolator.

Figure 6:
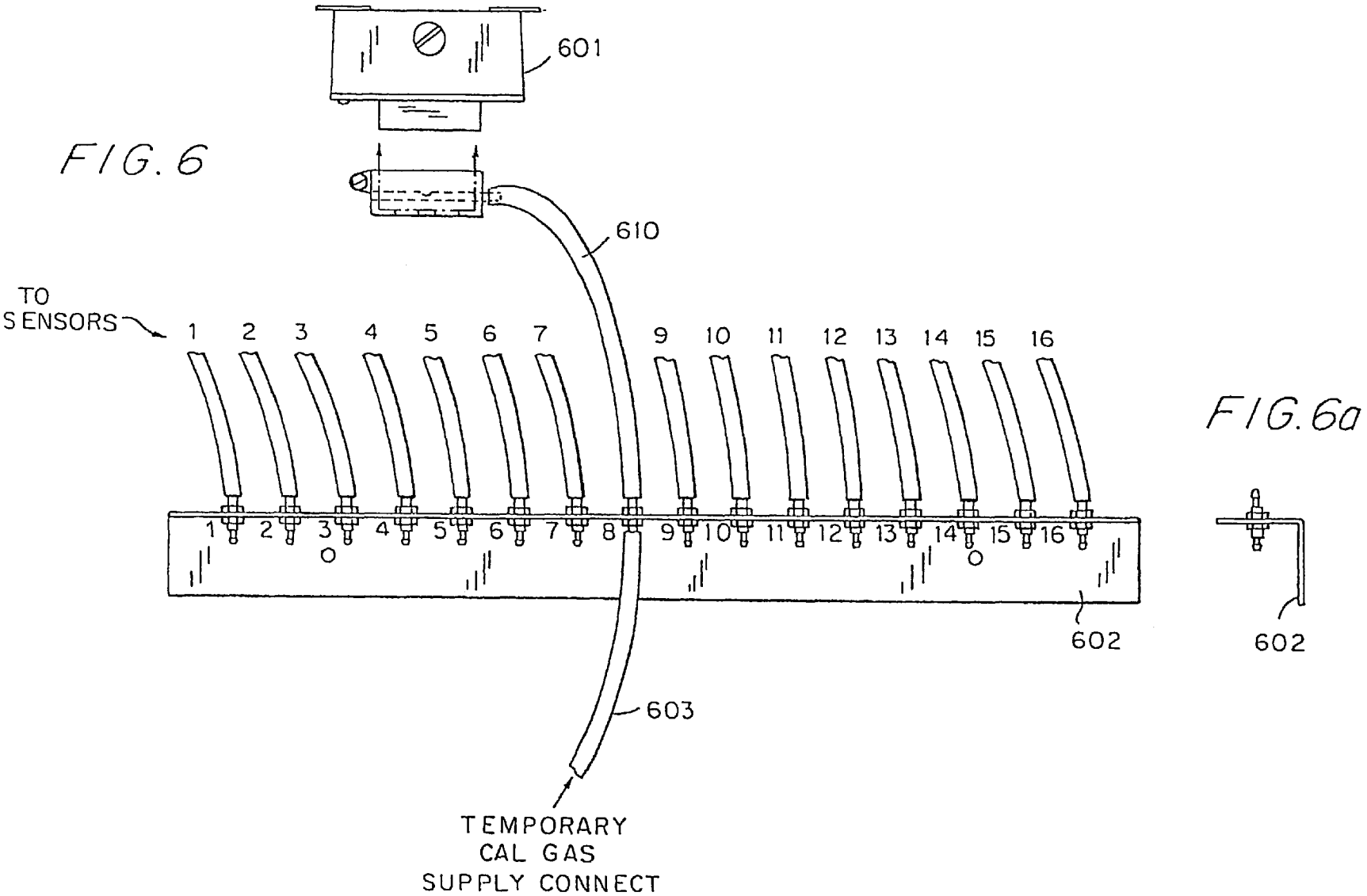
FIG. 6 illustrates remote calibration of the sensors.
Figure 7:
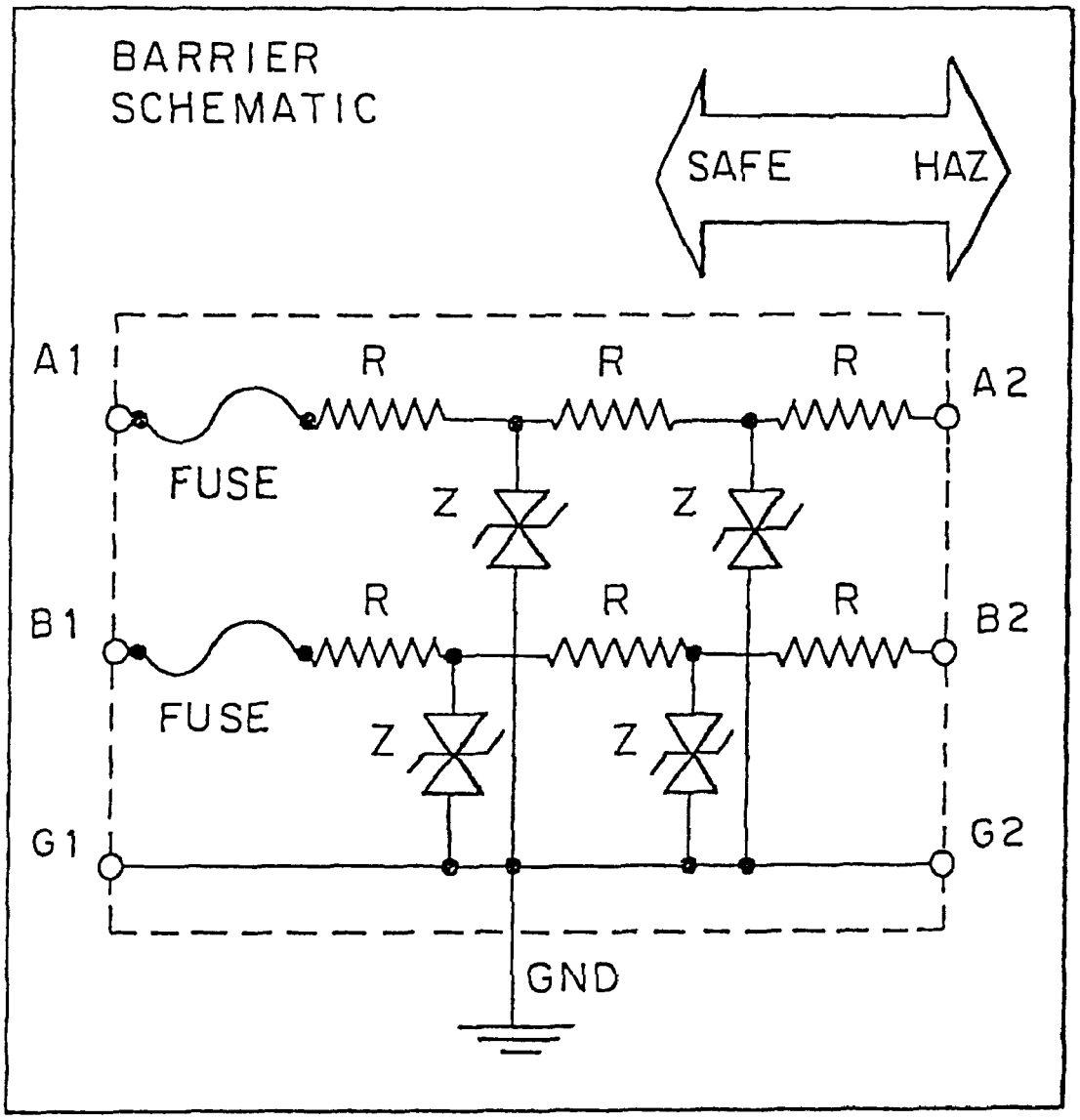
FIG. 7 is a schematic of the intrinsic safety barriers used in the present invention.

Referring to FIG. 6, to calibrate the sensors remotely, we refer for the sake of clarity to a specific embodiment-calibration of gas monitors, noting that this in no way limits the type of environmental parameters that may be monitored by the instant invention. Thus, for a gas sensor, calibration gas is transmitted through a permanently installed ⅛" internal diameter tubing 610 leading to each sensor 601. A gas manifold 602, usually mounted beside the box unit, contains selectable hose barbs, one dedicated to each sensor, which the operator can temporarily attach to a gas supply tubing. To calibrate the sensor, first zero gas is applied (i.e., pure air, with no methane or other contaminants) through the temporary gas supply tubing 603. After the sensor 601 has been allowed to stabilize for up to two minutes, as indicated on a portable test meter (not shown) monitoring the signals 512 (FIG. 5), the "zero" value is adjusted using the zero potentiometer for that particular sensor on the circuit card 509 (FIG. 5). Then the calibration gas supply is switched to another tank containing a known concentration of methane, (or other) gas. After waiting for the sensor to stabilize at this higher level, the "span" potentiometer 512 (FIG. 5) for that sensor is adjusted to read the correct analog value corresponding to the gas concentration applied. The process may be repeated, if necessary. Each sensor is similarly calibrated. It should be noted that the Rem-Cal circuitry requires a meaningful signal from the sensor in order to operate. Thus, if a sensor is excessively out of calibration, or possibly dysfunctional, the Rem-Cal adjustments will not suffice, and the defective sensor must be approached and serviced directly. However, the present invention does provide for installing automatic and/or manual calibration equipment directly inside or beside the unit box, so as to facilitate the calibration process as much as possible (4).

The Rem-Cal circuitry generates a new, calibrated 4–20 mA analog signal, faithful to the uncalibrated, linear sensor output signal. This new signal is generated within the Rem-Cal module with circuitry powered from the input power source, the signal returning from the sensor having been terminated into a low ohmage resistor at the sensor side of the Rem-Cal module. Without this Rem-Cal function, the sensor signal would pass through to the monitoring circuit, which, if used with alien monitoring circuits, might have high termination resistance and which would require substantial voltage to drive to full scale. For example, programmable logic controllers (PLCs) terminate 4–20 ma analog signals into 250 ohm resistors, thus requiring 5 volts to full scale (250×20 ma=5V). Since intrinsic safety barriers normally output about 15 VDC under full load, and since the sensor requires at least 11 VDC to function properly, this allows just 4 VDC for voltage drops from cable resistance, barrier return resistance and the previously mentioned termination resistance. For this reason, intrinsic safety sensors are not easily used with programmable logic computers, opting for explosion-proof sensor and wiring technology that is significantly more costly to purchase, install and maintain. However, by terminating the return signal into a low resistance and regenerating a new analog signal, the high PLC terminating resistance is removed from the barrier/sensor voltage budget, thus enabling use of the intrinsic sensors with these popular programmable logic controllers.

The Rem-Cal circuitry can be used to regulate current. DC power, usually 24–30 VDC, must be limited so as to avoid applying excess voltage or current to the barrier, beyond the capabilities of the barrier to bypass the excess to ground. Most barrier applications use voltage regulators for this purpose, set slightly above the voltage limit of the zener diodes contained with the barrier. Because zener voltage ratings normally have a 5% or 10% tolerance, the regulator voltage must be sufficiently low to be acceptable to the lowest zener value, i.e., within a barrier and, indeed, within all connected barriers. This generates a performance penalty, in that the maximum power transfer is not attainable using "voltage" regulation. The Rem-Cal circuitry used in the unit box of the present invention contains "current" regulators which supply a designated current (e.g., 95 ma) continuously into each barrier. This current drives the first zener stage up to its rated conducting voltage value. During manufacture of the barriers, the first stage zener is selected to be on the high side of the zener tolerance population, thus maximizing the barrier's energy throughput to the sensor. This extra voltage is important if sensors are far away and wire sizes are small, causing voltage drops in the supply and signal return lines. An important benefit of the current regulator over the voltage regulation approach is that the former makes the barriers short-circuit protected, thus eliminating the need for fuses and costly damage to barriers.

FIG. 6 shows a schematic for the intrinsic safety barrier used in the unit box of the present invention. Electrical power (typically 11–24 VDC, 95 ma) is supplied to each intrinsically safe sensor through one channel of one of the intrinsic safety barriers located in a column on the right side of the unit box. The 4–20 ma signal from a sensor returns into the box through a second channel of the same barrier. Each barrier channel limits the voltage and current to the sensor to a low level, such that there is not sufficient sparking energy to ignite the most sensitive mixtures, e.g., methane and air, at the sensor site, or along the shielded cable leading back to the barrier output terminals. The barrier conducts any excess voltage or current to ground, or, if of sufficient magnitude, will blow one of the non-replaceable fuses, typically ¼ A rating, embedded in the barrier unit.

Signal Monitoring and Telecommunications

Calibrated 4–20 mA sensor signals from the Rem-Cal modules are passed onto the DX4404B cards for monitoring. The DX cards are microprocessor-based circuit modules which handle the communications and the input/output signals. Each card is capable of monitoring four analog (4–20 ma) inputs and four digital contact closure inputs while controlling four digital (on/off) outputs, all orchestrated through the central computer facility, which can be sited at any remote location. Analog resolution is preferably a high precision 12–16 bit format, which cuts the digitizing error to 0.024%, and 0.0015%, respectively.

A family of input/output cards provides different quantities and mixtures of analog inputs, digital inputs, analog outputs, and digital outputs. The "DX" bus signifies a proprietary long-distance (ten-mile range) communication bus used for telemetering data and commands to and from the computer, typically a Pentium PC running Windows 95 or Windows NT. The DX bus is produced by Rel-Tek of Monroeville, Pa. The preferred card for use in the DX calibar is the DX4404C where "DX" is the bus designation; 4xxx means four analog outputs, x4xx means four digital inputs, xx0x means no analog inputs, and xxx4 means four digital outputs, and "C" signifies an advanced version having relay outputs. Thus, the four sensor signals enter four analog input channels. The digital inputs are used for monitoring field and box-mounted switches, as for emergency stop, alarm reset and the like. The four digital outputs constitute output relays which are controllable from the computer for activating alarms, controlling plant equipment, etc.

The units require frequent communication with a computer. Telemetry with the central station is typically via the DX-bus over a single twisted pair of wires at a selectable baud rate, generally 2400, 9600, 19.2K or higher baud. The proprietary DX-bus and attendant protocols have been perfected for long distance and high reliability in noisy environments and include advance error detection and correction features.

Alternatively, the alarm-detection intelligence of the present invention may be contained entirely within the unit box, enabling monitoring of sensors and activation of alarms without a remote computer, also useful if said remote computer is not functional.

Integral Power Supply, Switches and Alarms

In order to further consolidate the peripheral boxes and components that require mounting and inter-wiring, the unit box of the present invention is designed to accommodate an AC/DC power supply and backup battery, one or more switches, and both visual and audible alarms, e.g., in the form of a strobe and a horn. A rechargeable standby battery is connected across the power supply output and resides at the bottom of the enclosure left of the barrier divider. A low voltage cut-off is provided to protect the battery from excessive discharge and to avoid inadequately powered sensors which may be unstable.

Digital meters, displays, keypads, and/or switches may be installed on the front side of a unit box to alert and interface with nearby personnel.

The foregoing description of the specific embodiments will so fully reveal the general nature of the invention that others can, by applying current knowledge, readily modify and/or adapt for various applications such specific embodiments without undue experimentation and without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation.

What is claimed is:

1. A field monitoring and communication system for detecting and signaling environmental conditions in a field area comprising:

a. sensor inputs for detecting the environmental conditions to be detected, said sensor units placed at appropriate locations-throughout the field are in-areas in which the environmental conditions are to be detected, and unit boxes, wherein a plurality of said sensors feed into one unit box and wherein each unit box contains a plurality of identical patents, each path having circuitry and potentiometers for adjusting the zero span of signals from each sensor;

b. alarm units located throughout the field area to warn when the environmental conditions to be detected exceed or fall beneath a predetermined level;

c. said unit boxes which receive information form said sensors being located in an area designated as non-hazardous and connected to one another and ultimately communicating with a computer in one continuous circuit;

d. said computer being located in a location remote from said unite boxes;

e. circuitry contained in said unit boxes for calibrating the sensors; and f. wherein said unit boxes contain dual-channel intrinsic safety barriers in the amount of one barrier for each sensor serviced by said unit box, wherein said intrinsically safe barriers transmit power to said sensors through a first barrier channel and retrieve an analog signal from the sensor through a second barrier channel.

2. The field monitoring and communication system according to claim 1 further including current regulators which supply a designated current continuously into each barrier.

3. The field monitoring and communication system according to claim 1 wherein sixteen sensors are provided per unit box.

4. The field monitoring and communication system according to claim 1 wherein said sensors are monitored by the computer at intervals not exceeding ten minutes.

5. The field monitoring and communication system according to claim 1 wherein the environmental condition to be detected is selected from the group consisting of humidity, smoke, temperature, pressure, vibrations, rpms, speed, turbidity, radio frequency, viscosity, force torque, voltage, current, frequency, shock, vibration, acoustics, and combinations thereof.

6. The field monitoring and communication system according to claim 1 further including relays for controlling functions selected from the group consisting of alarms, fans, doors, recorders, relays, shunt breakers, and combinations thereof.

7. The field monitoring and communication system according to claim 1 further including an AC/DC power supply.

8. The field monitoring and communication system according to claim 1 wherein the safety barriers are bi-polar.

9. The field monitoring and communication system according to claim 8 further including current limiters to protect the safety barriers against short circuits.

10. The field monitoring and communication system according to claim 1 wherein each unit box includes relays for controlling signals and plant functions.

11. The field monitoring system according to claim 10 wherein the plant functions are selected from the group consisting of fans, doors, and shunt breakers.

12. The field monitoring system according to claim 1 wherein a plurality of alarms are sited remotely from the unit box and are powered or controlled in unison or individually using outputs from the unit box.

* * * * *